US007093837B2

(12) United States Patent
Parker et al.

(10) Patent No.: US 7,093,837 B2
(45) Date of Patent: Aug. 22, 2006

(54) TURBINE SPRING CLIP SEAL

(75) Inventors: David Marchant Parker, Oviedo, FL (US); William Richard Ryan, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 377 days.

(21) Appl. No.: 10/255,896

(22) Filed: Sep. 26, 2002

(65) Prior Publication Data

US 2005/0062237 A1 Mar. 24, 2005

(51) Int. Cl.
*F16J 15/02* (2006.01)
*F01D 25/26* (2006.01)

(52) U.S. Cl. ..... 277/630; 277/654; 415/135

(58) Field of Classification Search ..... 60/800; 277/903, 632, 650, 654, 630; 415/135
See application file for complete search history.

(56) References Cited

U.S. PATENT DOCUMENTS

| | | | | |
|---|---|---|---|---|
| 2,124,108 | A * | 7/1938 | Grece | 277/356 |
| 3,144,255 | A * | 8/1964 | Thorne et al. | 277/632 |
| 3,759,038 | A | 9/1973 | Scalzo et al. | |
| 3,807,195 | A | 4/1974 | Faulbecker | |
| 3,938,906 | A | 2/1976 | Michel et al. | |
| 4,184,689 | A | 1/1980 | Brodell et al. | |
| 4,190,104 | A * | 2/1980 | Frei | 165/162 |
| 4,314,793 | A | 2/1982 | DeTolla et al. | |
| 4,376,542 | A | 3/1983 | Hennessy | |
| 4,413,470 | A * | 11/1983 | Scheihing et al. | 60/800 |
| 4,527,397 | A * | 7/1985 | Tobery et al. | 60/757 |
| 4,601,475 | A * | 7/1986 | Nicholson | 277/560 |
| 4,645,217 | A * | 2/1987 | Honeycutt et al. | 277/555 |
| 4,785,623 | A | 11/1988 | Reynolds | |
| 4,811,961 | A * | 3/1989 | Williams | 277/545 |
| 4,961,588 | A * | 10/1990 | Brienza | 277/545 |
| 5,100,158 | A * | 3/1992 | Gardner | 277/411 |
| 5,118,120 | A | 6/1992 | Drerup et al. | |
| 5,361,577 | A * | 11/1994 | Cromer | 60/800 |
| 5,400,586 | A | 3/1995 | Bagepalli et al. | |
| 5,797,723 | A | 8/1998 | Frost et al. | |
| 5,906,896 | A * | 5/1999 | Jackson et al. | 428/621 |
| 5,987,879 | A * | 11/1999 | Ono | 60/800 |
| 6,065,756 | A * | 5/2000 | Eignor et al. | 277/545 |
| 6,076,835 | A | 6/2000 | Ress et al. | |
| 6,164,656 | A | 12/2000 | Frost | |
| 6,402,466 | B1 | 6/2002 | Burdgick et al. | |
| 6,514,577 | B1 * | 2/2003 | Tomiyama | 427/580 |
| 6,644,667 | B1 * | 11/2003 | Grondahl | 277/355 |

* cited by examiner

*Primary Examiner*—Alison K. Pickard

(57) ABSTRACT

An improved turbine spring clip seal for directing gases to be mixed with fuel in a combustor basket. The turbine spring clip seal is composed of inner and outer housings and a center sealing member disposed between the inner and outer housings. The center sealing member is flexible and prevents a fluid, such as air, from leaking through the seal. In operation, the center sealing member flexes and is sealed against the outer housing by a pressure differential that is created by the relatively higher pressure on the inner housing side and the relatively lower pressure on the outer housing side.

20 Claims, 5 Drawing Sheets

TURBINE SPRING CLIP SEAL

CROSS REFERENCE TO RELATED APPLICATIONS

Not applicable.

STATEMENT REGARDING FEDERALLY SPONSORED RESEARCH

Not applicable.

FIELD OF THE INVENTION

The present invention relates in general to sealing systems and, more particularly, to an improved turbine spring clip seal for directing gases to mix with fuel in a combustor basket in a turbine engine.

BACKGROUND OF THE INVENTION

There exists a plethora of variables that affect performance of a turbine engine. One such variable that has been identified in dry-low NOx combustor design turbines is the air flow distribution between the combustor zone and the leakage air flows. Typically, a spring clip seal is used in such a turbine engine to direct gases, such as common air, into a combustor basket where the air mixes with fuel. Conventional spring clip seals direct air through center apertures in the seals and are formed from outer and inner housings. The seals are generally cylindrical cones that taper from a first diameter to a second, smaller diameter. The first diameter is often placed in contact with a transition inlet ring, and the second, smaller diameter is often fixedly attached to a combustor basket. The inner and outer housings include a plurality of slots around the perimeter of the housings which form leaves in the housing. The leaves are capable of flexing and thereby imparting spring properties to the spring clip seal. This spring force assists in at least partially sealing the inner housing to the outer housing.

Conventional spring clips allow up to 8% of the total air flow distribution flowing through a center aperture of a spring clip seal to leak through the seal. Such leakage can often cause undesirable outcomes. For instance, air leakage at this level can cause high engine performance variability, which is characterized by high NOx emissions, high dynamics or flashback, or any combination thereof.

Turbine spring clip seals have attempted to reduce leakage across the seal by configuring the inner housing and the outer housings to correspond to each other, thereby reducing leakage across the seal. However, each hundredth of an inch that separates the inner housing from the outer housing results in air leakage of about 2% of the total air flow through the center aperture of the spring clip seal. Thus, for a separation of about 3/100s of an inch between the inner and outer housings, which is common, the spring clip seal yields leakage of about 6% of the total air flow through the center aperture in the seal.

Therefore, there is a need for an improved turbine spring clip seal that reduces the amount of air leaking between an inner housing and an outer housing of the seal.

SUMMARY OF THE INVENTION

Set forth below is a brief summary of the invention that solves the foregoing problems and provides benefits and advantages in accordance with the purposes of the present invention as embodied and broadly described herein. This invention is directed to a turbine seal for sealing openings between adjacent turbine components and directing air through a center aperture in the seal. The turbine seal of the invention is generally composed of an outer housing and an inner housing with a center sealing member positioned between the outer and inner housings. The outer and inner housings each includes a coupler section and a transition section. The coupler section of the outer housing is configured to be fixedly attached to a first turbine component, and the transition section of the outer housing extends from the coupler section at a first end of the transition section. The transition section is also adapted to maintain contact between a second end of the transition section and a second turbine component during operation of a turbine. The transition section tapers from a first diameter at the first end of the transition section to a second diameter, which is larger than the first diameter, at the second end of the transition section.

The inner housing also has a coupler section and a transition section that may be shaped similarly to the outer housing but sized to nest within the outer housing. The inner coupler section of the inner housing is adapted to be fixedly attached to the outer coupler section of the outer housing. The inner transition extends from the inner coupler section at a first end of the inner transition section. The inner transition section continues to a second end of the transition section and secures to the outer housing during operation of the turbine. The inner housing is configured to fit inside the outer housing and, in one embodiment, tapers from a third diameter at the first end of the transition section to a fourth diameter, which is larger than the third diameter, at the second end of the inner transition section.

According to the invention, a center sealing member is positioned between the inner housing and the outer housing and is configured to prevent a fluid from passing therebetween. In one embodiment, the center sealing member includes a plurality of leaves formed by slots arranged around its perimeter. The inner and outer housings may also include slots forming leaves between adjacent slots. The center sealing member may be positioned relative to the outer housing so that the leaves of the center sealing member align with the slots of the outer housing, thereby preventing a fluid from passing through the outer housing slots. The center sealing member may also be aligned so that its leaves are aligned with slots in the inner housing, or alternatively, the leaves of the center sealing member can also be aligned with the slots of the inner housing in addition to the slots of the outer housing.

An object of this invention includes, but is not limited to, increasing the efficiency of a turbine engine by preventing a fluid, such as common air, from leaking between an inner housing and an outer housing of a seal while the fluid is directed to pass through a center aperture in the seal.

An advantage of this invention is that the turbine spring clip seal reduces leakage, and may stop leakage, between an inner housing and an outer housing of the spring clip seal. In one embodiment, the turbine spring clip seal of this invention reduces air leakage up to 8% of total air flow through the center aperture of a conventional spring clip seal to about 1% of the total air flow through the center aperture of the turbine spring clip seal of this invention. For each 1% reduction in air leakage through the seal, NOx is reduced.

Another advantage of this invention is that such reduction, or elimination, of leakage between the inner and outer housings may result in reduced NOx levels and reduced propensities for flashback and accompanying dynamic instabilities.

These and other advantages and objects will become apparent upon review of the detailed description of the invention set forth below.

DETAILED DESCRIPTION OF THE INVENTION

Figure 2:
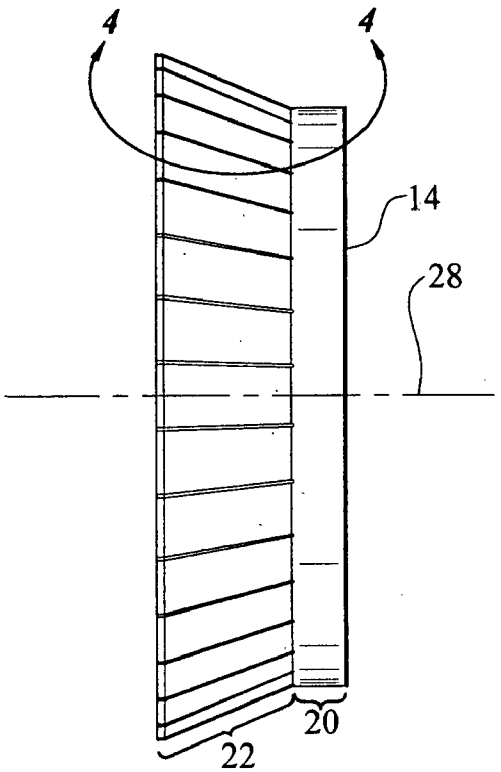
FIG. 2 is a right side view of the turbine spring clip seal of FIG. 1.
Figure 1:
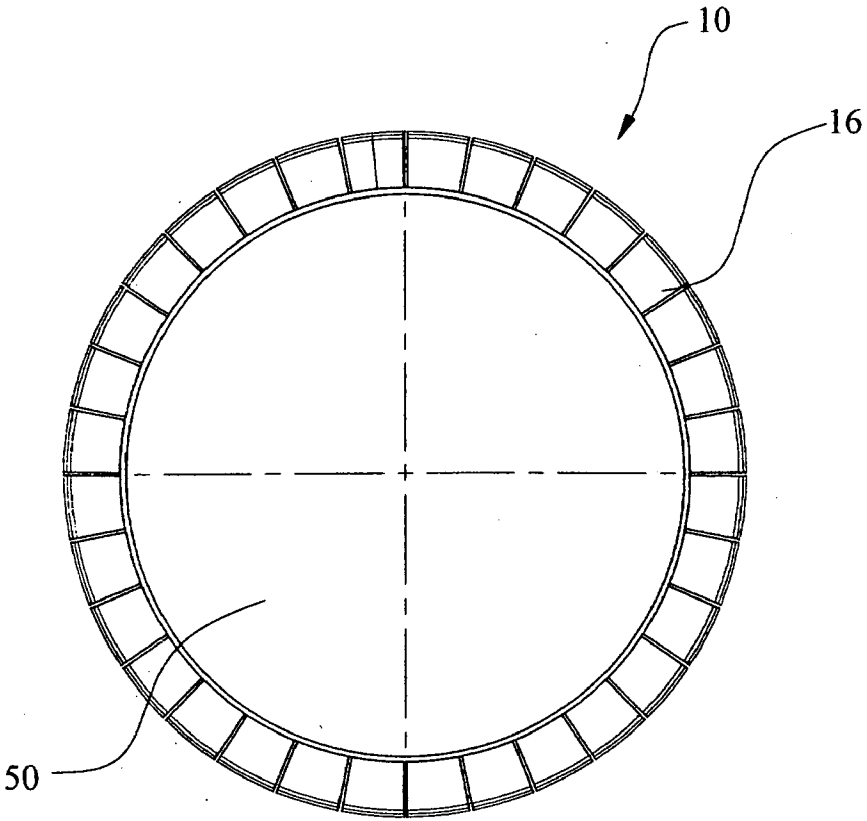
FIG. 1 is a front view of a turbine spring clip seal composed of an outer housing, an inner housing, and a center sealing member, viewed so that the inner housing is shown first.

Referring to FIGS. 1 and 2, a turbine spring clip seal 10 can be configured as a generally cylindrical- or ring-shaped assembly, including an outer housing 14 and an inner housing 16. A turbine spring clip seal 10, such as one according to the invention, is usable in turbine engines to direct gases to mix with fuel flowing into a conventional combustor basket 12 (see FIG. 8). The spring clip seal is intended to direct fluid flow and to prevent at least a portion of air directed through the center aperture 50 in the turbine spring seal from leaking between the inner and outer housings 14 and 16. The flow region within the center aperture 50 is relatively higher in pressure than the region outside housing 14, so that fluid leakage generally occurs from the inside out. According to the invention the sealing capabilities of the seal 10 are improved through the use of a center sealing member.

Figure 3:
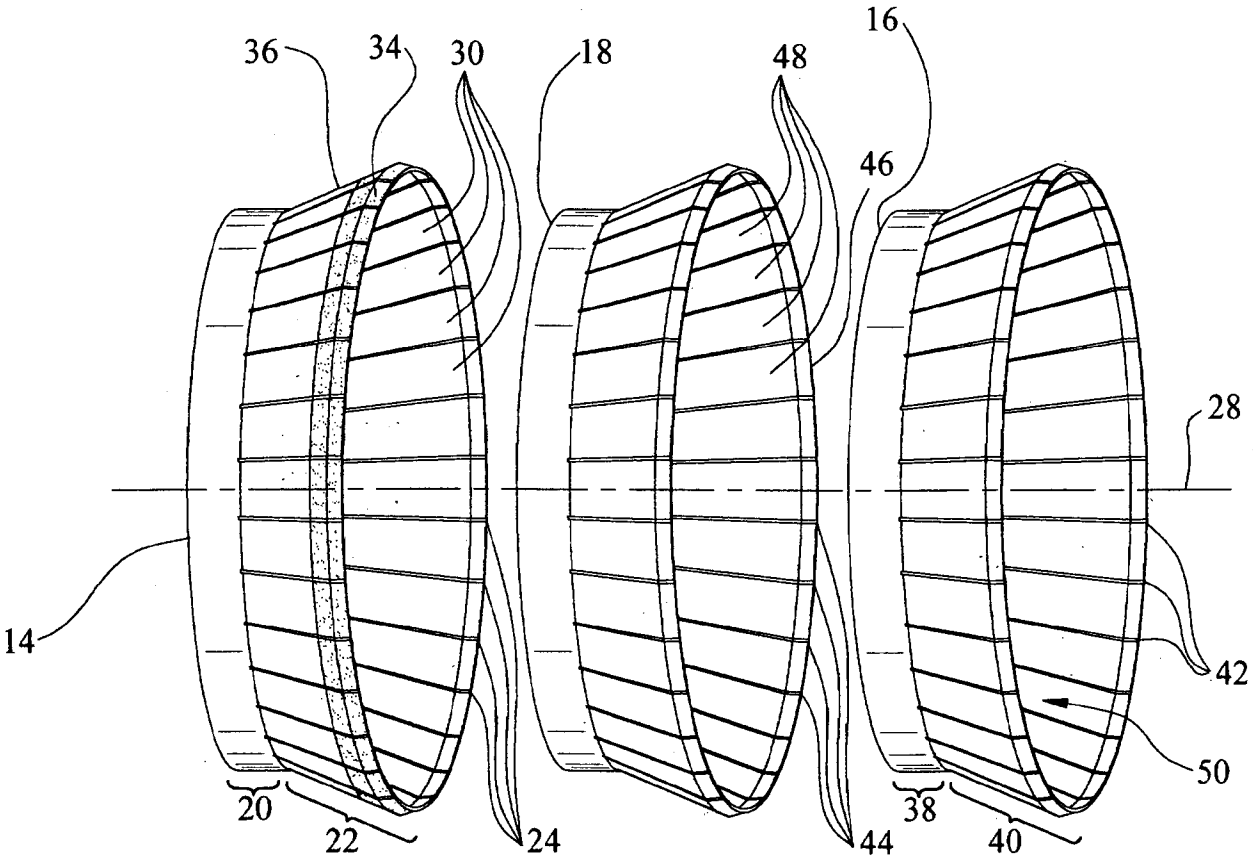
FIG. 3 is an exploded side view of the turbine spring clip seal of FIG. 1.
Figure 4:
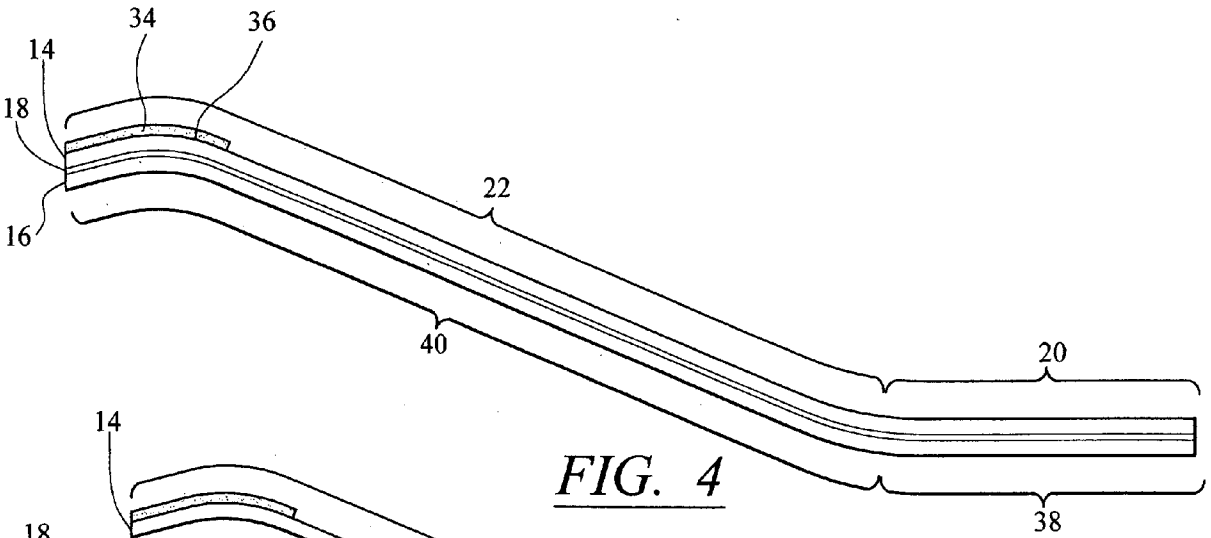
FIG. 4 is a cross-sectional view of the turbine spring clip seal of FIG. 1.
Figure 5:
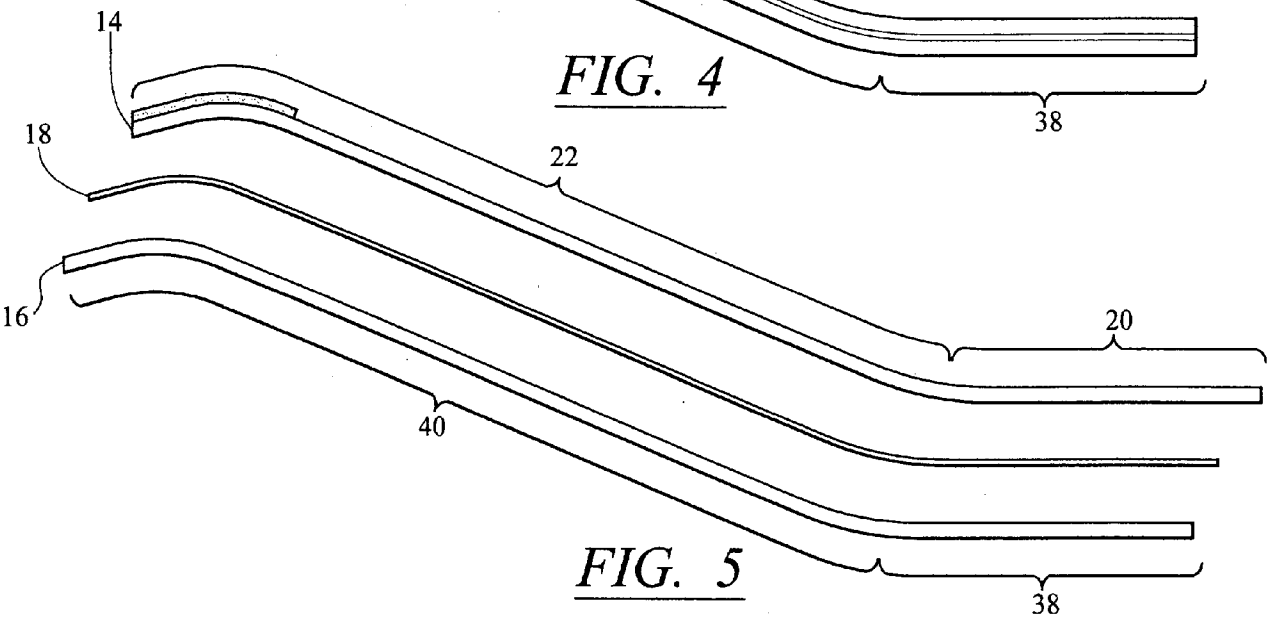
FIG. 5 is an exploded cross-sectional view of the turbine spring clip seal of FIG. 4.

As shown in FIGS. 3–5, the turbine spring clip seal 10 is formed from an outer housing 14, an inner housing 16 and, according to the invention, a center sealing member 18. In one embodiment, the outer and inner housings 14 and 16 have the same general configuration, and the outer housing 14 is sized to receive the inner housing 16 in nested fashion. The center sealing member 18 can also be constructed as a ring and nests with the outer housing 14, while the inner housing 16 nests within the center sealing member 18.

The outer housing 14 provides an outer coupler section 20 and an outer transition section 22 extending therefrom. In one embodiment, the outer housing 14 may have a configuration resembling a conventional reducer and have a generally conical shape, although alternative geometries are considered within the scope of the invention. The outer coupler section 20 may be in the shape of a ring and is configured to be fixedly attached to a turbine component using for instance, a weld bond. In one embodiment, the outer coupler section 20 is fixedly attached to a combustor basket 12 (see FIG. 8). In one embodiment, the outer transition section 22 has a general conical shape for deflecting air toward the center opening of the transition section 22 during operation.

The outer housing 14 also may include a plurality of slots 24 that are typically located in the outer transition section 22. The slots 24 preferably extend from an edge of the outer transition section 22 into the outer transition section 22 toward the outer coupler section 20. The slots 24 may have any length, and in one embodiment, one or more of the slots 24 may extend to the outer coupler section 20. In yet another embodiment, the slots 24 may extend through the width of the transition section 22 and into the coupler section 20. However, the slots 24 should not extend completely through the coupler section 20.

The plurality of slots 24 may be composed of two or more slots and, in one embodiment, may be composed of thirty-two slots. The slots 24 are positioned generally parallel to a longitudinal axis 28 of the turbine spring clip seal 10 and the outer housing 14 and form leaves 30 between adjacent slots 24. The leaves 30 are flexible and are capable of deflecting inwardly.

The outer housing 14 may also include a wear resistant material 34 for reinforcing the turbine spring clip seal 10 at its juncture with a turbine component 32. The wear resistant material 34 may be applied to the outer surface 36 of the outer housing 14 in any location that the outer housing 14 contacts a turbine component 34. In one embodiment, the wear resistant material 34 is applied to the outer surface 36 of the outer housing 14 proximate to the edge of the outer transition section 22 and extending about one inch toward the outer coupler section 20. If the outer housing 14 includes slots 24, the wear resistant material 34 is located on the leaves 30 formed by the slots 24.

In one embodiment, the wear resistant material 34 is composed of chromium carbide and is spray applied. However, the wear resistant material 34 and the method of application are not limited to this material or method. Rather, the wear resistant material 34 may consist of other materials capable of withstanding the hot environment of a turbine engine and may be applied using application methods such as, but not limited to, dipping, anodizing, and other methods.

Figure 8:
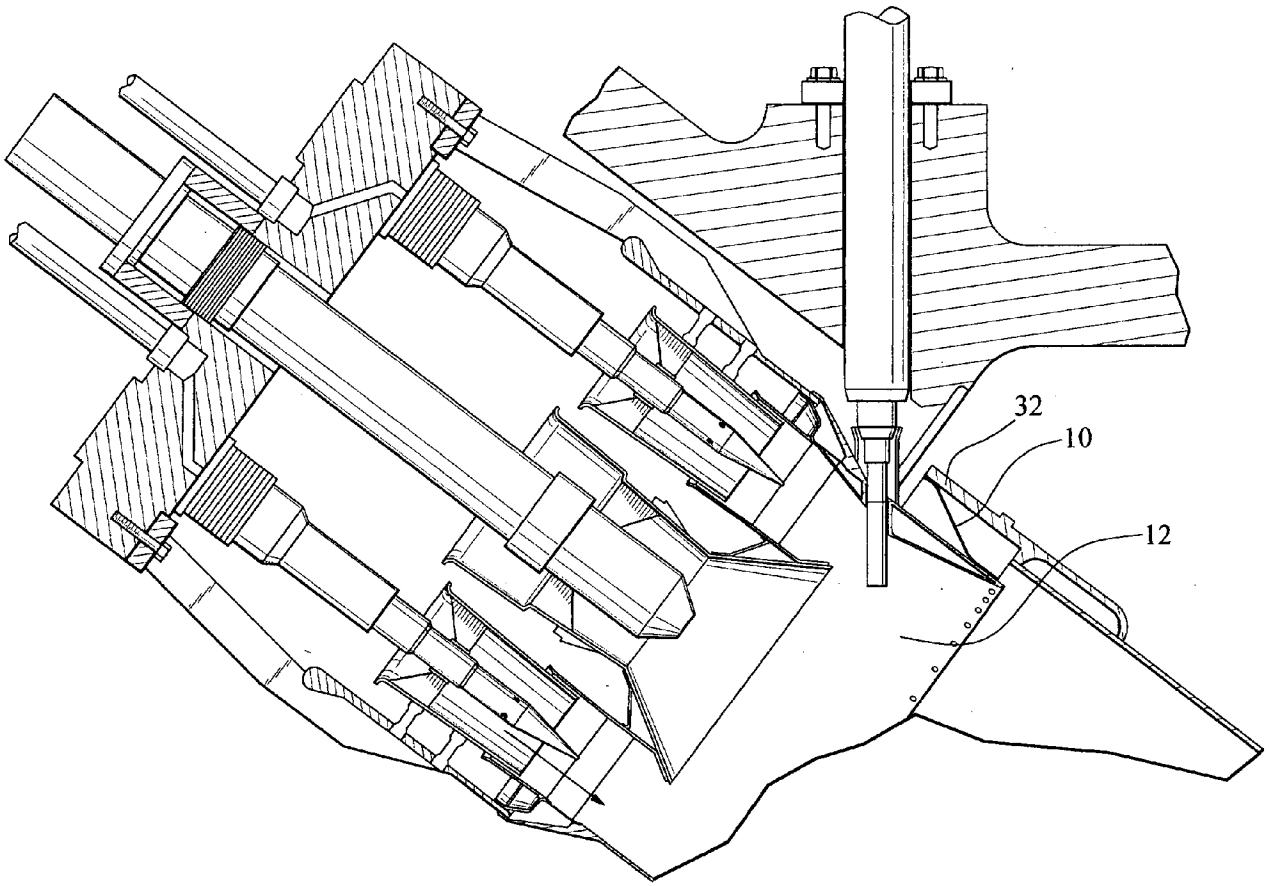
FIG. 8 is a partial cross-section of turbine engine showing the turbine spring clip seal of FIG. 1 installed between a transition inlet ring and a combustor basket.

Typically, the outside diameter of the outer housing 14 is slightly greater than the inside diameter of the turbine component 32 in which the turbine spring clip seal 10 is positioned (see FIG. 8). Such a configuration forms an interference fit with the turbine component 32 and is useful to form an airtight seal. In one embodiment, the turbine component 32 is a transition inlet ring.

Referring again to FIGS. 3–5, the inner housing 16 is substantially similar in configuration to the outer housing 14 and the inner housing 16 includes all of the elements discussed above. For example, the inner housing 16 includes an inner coupler section 38 and an inner transition section 40 extending therefrom. The inner transition section 40 may include a plurality of slots 42, numbering two or more, that may be generally parallel to the longitudinal axis 28 of the turbine spring clip seal 10 and the inner housing 16. The inner coupler section 38 of the inner housing 16 is configured to be attached to the outer coupler section 20 of the outer housing 14, and the inner housing 16 is configured to fit inside the outer housing 14.

The inner and outer housing 14 and 16 may be formed from any high strength and high temperature material, such as, but not limited to, X750 or a nickel based material. The inner and outer housings 14 and 16 may each have a thickness of about 0.050 of an inch. However, the thickness of the inner and outer housings 14 and 16 are not limited to this thickness. Rather, the thickness may vary depending on the material used in order to maintain the flexibility of the turbine spring clip seal 10.

The turbine spring clip seal 10 further includes a center sealing member 18 sized and configured to fit between the inner and outer housings 14 and 16. The center sealing member 18 generally has a shape similar to the shape of the inner and outer housings 14 and 16, and in one embodiment, may be substantially identical to the inner and outer housings 14 and 16. The center sealing member 18 is flexible so that during operation of a turbine in which the seal 10 is positioned, the pressure drop between the relatively higher pressure within the center aperture 50 and the relatively lower region outside the outer housing 14, as discussed above, causes the center sealing member 18 to be drawn against the outer housing 14. In one embodiment, adequate flexibility may be achieved by forming the center sealing member 18 from a metal, such as, but not limited to, a 300 series stainless steel or a nickel based sheet material, having a thickness between about 0.004 of an inch and about 0.015 of an inch. It is evident to those of ordinary skill in the art that the thickness of the material will vary depending on the strength of the material used to form the center sealing member 18. Thus, the various thicknesses for alternative materials are not discussed.

The center sealing member 18 may also include a plurality of slots 44 positioned around the outer perimeter 46 in a configuration similar to the configuration of slots in the inner and outer housings 14 and 16. In one embodiment, the slots 44 are equally spaced. The slots 44 provide increased flexibility to the perimeter 46 of the center sealing member 18 by providing a series of flexible leaves 48.

Figure 7:
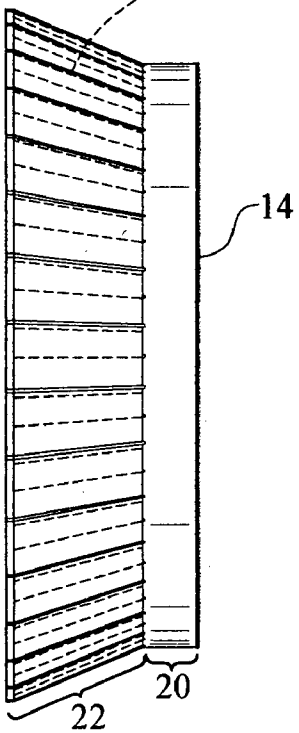
FIG. 7 is a right side view of the turbine spring clip seal of FIG. 6.
Figure 6:
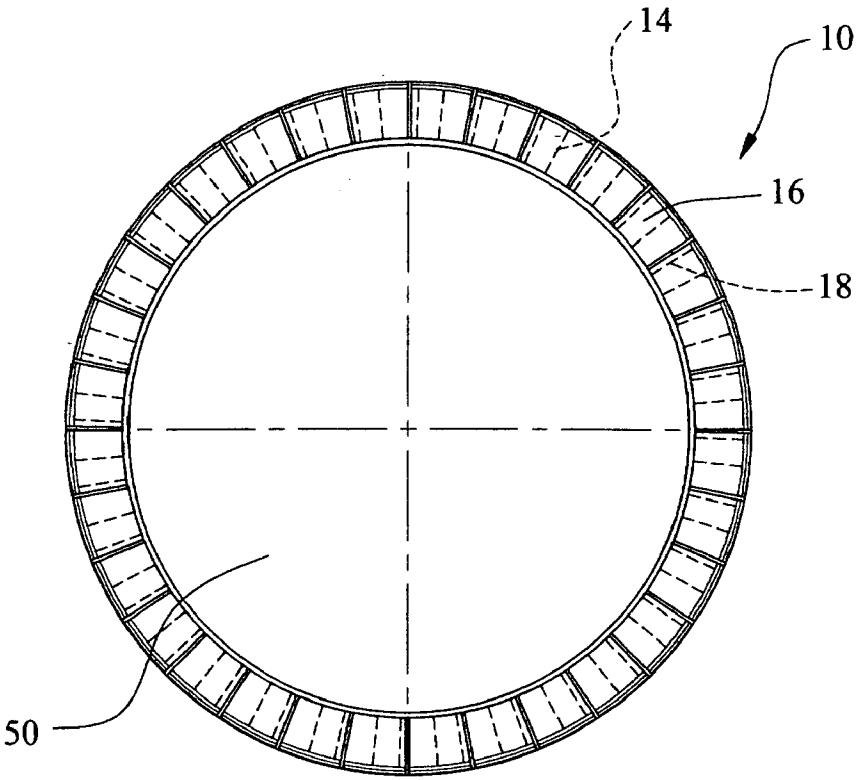
FIG. 6. is a front view of the turbine spring clip seal of FIG. 1, wherein the slots in the center seal are misaligned with the slots in the outer seal.

Referring to FIGS. 6 and 7, when the turbine spring clip seal 10 is fully assembled, the center sealing member is oriented relative to the outer housing so that the leaves of the center sealing member cover the slots 24 in the outer housing 14, as shown in FIG. 6. In other words, the slots 44 in the center sealing member 18 are not aligned with the slots 24 in the outer housing 14. Thus, a fluid, such as, but not limited to, common air, does not have a direct flow path through the turbine spring clip seal 10.

In an assembled turbine spring clip seal 10, the slots 42 in the inner housing 16 are typically aligned with the slots 44 in a center sealing member 18, and the slots 24 in the outer housing 14 are misaligned with the slots 44 in the center sealing member 18 and the slots 42 of the inner housing. In yet another embodiment, the slots 42 in the inner housing 16 are misaligned with the slots 44 in the center sealing member 18, and the slots 24 in the outer housing 14 are misaligned with the 44 slots in the center sealing member 18. In yet another embodiment, the slots 24 in the outer housing 14 are aligned with the slots 44 in the center sealing member 18. These configurations prevent at least a portion of air directed through the center aperture 50 in the turbine spring seal from leaking between the inner and outer housings 14 and 16 and, may prevent most leakage across the seal.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

What is claimed is:

1. A turbine seal, comprising:

an outer housing having an outer coupler section adapted to be attached to a first turbine component and an outer transition section extending from the outer coupler section at a first end of the outer transition section and continuing to a second end of the outer transition section, adapted to be attached to a second turbine component during operation of a turbine, wherein the outer transition section tapers from a first diameter at the first end of the outer transition section to a second diameter, which is larger than the first diameter, at the second end of the outer transition section;

an inner housing having an inner coupler section adapted to be attached to the outer coupler section of the outer housing and an inner transition section extending from the inner coupler section at a first end of the inner transition section and continuing to a second end of the inner transition section, attached to the outer housing during operation of the turbine;

wherein the inner housing is configured to fit inside the outer housing and the inner transition section tapers from a third diameter at the first end of the inner transition section to a fourth diameter, which is larger than the third diameter, at the second end of the inner transition section;

a center sealing member positioned between the inner housing and the outer housing and including a plurality of slots forming leaves between adjacent slots; and wherein the outer housing provides a plurality of outer slots forming outer leaves between adjacent outer slots in the outer transition section of the outer housing and wherein the center sealing member is positioned relative to the outer housing so that the slots in the center sealing member align with the outer slots in the outer housing.

2. The turbine seal of claim 1, wherein the slots of the center sealing member are generally parallel to a longitudinal axis of the center sealing member and the center sealing member extends around the periphery of the inner housing.

3. The turbine seal of claim 1, wherein the center sealing member is comprised of metal.

4. The turbine seal of claim 1, wherein the center sealing member has a thickness between about 0.004 of an inch and about 0.015 of an inch.

5. The turbine seal of claim 1, wherein the outer housing and the inner housing each have a thickness of about 0.050 of an inch.

6. The turbine seal of claim 1, wherein the outer housing slots are generally parallel to a longitudinal axis of the outer housing.

7. The turbine seal of claim 6, wherein the outer housing slots extend from the first end of the outer transition section of the outer housing to the outer coupler section of the outer housing.

8. The turbine seal of claim 1, wherein the inner housing includes a plurality of inner housing slots forming inner leaves between adjacent inner slots in the inner transition section of the inner housing, and the inner housing slots are generally parallel to a longitudinal axis of the inner housing.

9. The turbine seal of claim 8, wherein the inner housing slots extend from the first end of the inner transition section of the inner housing to the inner coupler section of the inner housing.

10. The turbine seal of claim 1, wherein the outer transition section of the outer housing further includes a coating on at least an outside surface of the outer housing and positioned proximate to the first end of the outer transition section of the outer housing for contacting a second turbine component when installed for operation in a turbine.

11. The turbine seal of claim 10, wherein the coating is a spray applied coating comprising chromium carbide.

12. The turbine seal of claim 1, wherein the first turbine component to which the coupler section of the outer housing is adapted to contact is a combustor basket.

13. A turbine seal, comprising:

an outer housing having an outer coupler section adapted to be attached to a first turbine component and an outer transition section extending from the outer coupler section at a first end of the outer transition section and continuing to a second end of the outer transition section, adapted to be attached to a second turbine component during operation of a turbine, wherein the outer transition section tapers from a first diameter at the first end of the outer transition section to a second diameter, which is larger than the first diameter, at the second end of the outer transition section;

an inner housing having an inner coupler section adapted to be attached to the outer coupler section of the outer housing and an inner transition section extending from the inner coupler section at a first end of the inner transition section and continuing to a second end of the inner transition section, attached to the outer housing during operation of the turbine;

wherein the inner housing is configured to fit inside the outer housing and the inner transition section tapers from a third diameter at the first end of the inner transition section to a fourth diameter, which is larger than the third diameter, at the second end of the inner transition section;

a center sealing member positioned between the inner housing and the outer housing and including a plurality of slots forming leaves between adjacent slots; and wherein the inner housing provides a plurality of inner slots forming inner leaves between adjacent inner slots in the inner transition section of the inner housing and wherein the center sealing member is positioned relative to the inner housing so that the slots in the center sealing member align with the inner slots in the inner housing.

14. The turbine seal of claim 13, wherein the slots of the center sealing member are generally parallel to a longitudinal axis of the center sealing member and the center sealing member extends around the periphery of the inner housing.

15. The turbine seal of claim 13, wherein the center sealing member is comprised of metal.

16. The turbine seal of claim 13, wherein the center sealing member has a thickness between about 0.004 of an inch and about 0.015 of an inch, and the outer housing and the inner housing each have a thickness of about 0.050 of an inch.

17. The turbine seal of claim 13, wherein the outer housing includes a plurality of outer housing slots forming outer leaves between adjacent outer slots in the outer transition section of the outer housing, and wherein the outer housing slots are generally parallel to a longitudinal axis of the outer housing and extend from the first end of the outer transition section of the outer housing to the outer coupler section of the outer housing.

18. The turbine seal of claim 13, wherein the inner housing slots are generally parallel to a longitudinal axis of the inner housing, and the inner housing slots extend from the first end of the inner transition section of the inner housing to the inner coupler section of the inner housing.

19. The turbine seal of claim 13, wherein the outer transition section of the outer housing further includes a coating comprising chromium carbide on at least an outside surface of the outer housing and positioned proximate to the first end of the outer transition section of the outer housing for contacting a second turbine component when installed for operation in a turbine.

20. The turbine seal of claim 13, wherein the first turbine component to which the coupler section of the outer housing is adapted to contact is a combustor basket.

* * * * *